US011719083B2

(12) United States Patent
Arshad et al.

(10) Patent No.: US 11,719,083 B2
(45) Date of Patent: Aug. 8, 2023

(54) MAINTAINING INTEGRITY OF LOWER COMPLETION FOR MULTI-STAGE FRACTURING

(71) Applicants: Saudi Arabian Oil Company, Dhahran (SA); Baker Hughes Oilfield Operations LLC, Houston, TX (US)

(72) Inventors: Waheed Syed Arshad, Mississauga (CA); Agung Kuswiranto, Aberdeen (GB); Mohammed Parvez Khan, Al Khobar (SA)

(73) Assignees: Saudi Arabian Oil Company, Dhahran (SA); Baker Hughes Oilfield Operations LLC, Houston, TX (US)

( * ) Notice: Subject to any disclaimer, the term of this patent is extended or adjusted under 35 U.S.C. 154(b) by 150 days.

(21) Appl. No.: 17/404,881

(22) Filed: Aug. 17, 2021

(65) Prior Publication Data

US 2023/0057873 A1 Feb. 23, 2023

(51) Int. Cl.
*E21B 43/26* (2006.01)
*E21B 43/14* (2006.01)
(Continued)

(52) U.S. Cl.
CPC ..... *E21B 43/26* (2013.01); *E21B 33/122* (2013.01); *E21B 33/124* (2013.01); *E21B 43/14* (2013.01);
(Continued)

(58) Field of Classification Search
CPC ..... E21B 43/26; E21B 33/122; E21B 33/124; E21B 43/14; E21B 47/00; E21B 2200/20; E21B 47/07
(Continued)

(56) References Cited

U.S. PATENT DOCUMENTS 3,720,263 A 3/1973 Murphy et al.
7,757,774 B2 7/2010 Ring
(Continued)

FOREIGN PATENT DOCUMENTS

CA 2579116 8/2007
CN 103696750 A * 4/2014
(Continued)

OTHER PUBLICATIONS

Sugden, Catherine, et al. "Special considerations in the design optimization of the production casing in high-rate, multistage-fractured shale wells." SPE Drilling & Completion 27.04 (2012). pp. 459-472. (Year: 2012).*
(Continued)

*Primary Examiner* — John E Johansen
(74) *Attorney, Agent, or Firm* — Fish & Richardson P.C.

(57) ABSTRACT

A method includes designing a lower completion string for a multi-stage hydraulic fracturing job for a wellbore drilled into a subterranean zone. The lower completion string includes a plurality of stages and a plurality of packers configured to isolate each of the stages. Each stage of the plurality of stages includes a respective tubular stage assembly, and each stage is configured to be placed within a respective one of a plurality of frac intervals of the wellbore defined by the plurality of packers. Designing the lower completion string includes, for each stage of the plurality of stages, receiving a measured hole diameter of the respective one of the plurality of frac intervals and performing an axial safety factor analysis of the stage. The axial safety factor analysis includes a comparison of a yield strength in tension or compression of the respective tubular stage assembly of the stage with calculated effective axial tensile or compressive forces to which the respective tubular stage assembly of the stage would be subject when positioned in the frac
(Continued)

interval in the wellbore. The axial safety factor analysis uses a predicted anchored status of the lower completion string, which includes an extent to which the respective tubular stage assembly would be predicted to elongate or contract when the lower completion string is positioned in the wellbore and the plurality of packers are set. The axial safety factor analysis also uses a distance between a first packer of the plurality of packers isolating the stage and a second packer of the plurality of packers isolating the stage, and the measured hole diameter of the respective frac interval. The method also includes determining that the axial safety factor analysis for each stage of the plurality of stages satisfies a threshold and, in response to the determining that the threshold is satisfied for each stage of the plurality of stages, inserting the lower completion string into the wellbore and performing the multi-stage hydraulic fracturing job.

20 Claims, 6 Drawing Sheets

(51) Int. Cl.
*E21B 47/07* (2012.01)
*E21B 33/122* (2006.01)
*E21B 33/124* (2006.01)
*E21B 47/00* (2012.01)

(52) U.S. Cl.
CPC ..... *E21B 47/00* (2013.01); *E21B 47/07* (2020.05); *E21B 2200/20* (2020.05)

(58) Field of Classification Search
USPC ..... 703/10
See application file for complete search history.

(56) References Cited

U.S. PATENT DOCUMENTS

| | | | | |
|---|---|---|---|---|
| 8,768,671 | B2 | 7/2014 | Lee et al. | |
| 8,800,650 | B2 | 8/2014 | Spray et al. | |
| 8,855,988 | B2 | 10/2014 | Strobel et al. | |
| 9,556,720 | B2 | 1/2017 | Onda et al. | |
| 10,087,722 | B2 | 10/2018 | Lecerf et al. | |
| 10,280,731 | B2 | 5/2019 | Aitken | |
| 2004/0103376 | A1 | 5/2004 | Pandey | |
| 2007/0294034 | A1 | 12/2007 | Bratton et al. | |
| 2013/0140037 | A1* | 6/2013 | Sequeira, Jr. ..... | E21B 7/04 703/10 |
| 2013/0311147 | A1 | 11/2013 | Greenwood | |
| 2016/0053591 | A1 | 2/2016 | Hallundbaek et al. | |
| 2016/0115771 | A1 | 4/2016 | Ganguly et al. | |
| 2017/0058669 | A1 | 3/2017 | Lakings et al. | |
| 2017/0103144 | A1 | 4/2017 | Badri et al. | |
| 2018/0355707 | A1 | 12/2018 | Rodriguez Herrera et al. | |
| 2021/0302619 | A1 | 9/2021 | Al-Qahtani et al. | |

FOREIGN PATENT DOCUMENTS

| | | |
|---|---|---|
| RU | 2687668 | 5/2019 |
| WO | WO 2016025672 | 2/2016 |

OTHER PUBLICATIONS

PCT International Search Report and Written Opinion in International Appln. No. PCT/US2022/075028, dated Oct. 27, 2022, 14 pages.

"Steering Techniques" ED—Darl Kuhn, An IP.com Prior Art Database Technical Disclosure, Jun. 2014, XP013163163, 32 pages.

Aldawood et al., "Integrated Pre-Well Planning Process to Improve Service Quality and Decrease Risk by Cooperation between Drilling and Geoscience," Society of Petroleum Engineers, Jan. 1, 2011, 8 pages.

Cayeux et al., "Well Planning Quality Improved Using Cooperation between Drilling and Geosciences," Society of Petroleum Engineers, Jan. 1, 2001, 9 pages.

Chen et al., "Case Study: Casing Deformation Caused by Hydraulic Fracturing-Induced Fault Slip in the Sichuan Basin," URTeC: 2882313, Unconventional Resources Technology Conference, Jul. 23-25, 2018, 9 pages.

Furui et al., "A Comprehensive Modeling Analysis of Borehole Stability and Production-Liner Deformation for Inclined/Horizontal Wells Completed in a Highly Compacting Chalk Formation," SPE-123651-PA, SPE Drill & Compl, Dec. 2010, 25(04): 530-543, 14 pages.

Gui et al., "Well Planning and Stimulation Optimisation by Integrating 3D Geomechanics for a Horizontal Well in the Northern Cooper Basin," Society of Petroleum Engineers, Oct. 25, 2016, 15 pages.

Hammerlindl, "Basic Fluid and Pressure Forces on Oilwell Tubulars," 3. SPE-7594, J Pet Technol, Jan. 1980, 32(1), 7 pages.

Hammerlindl, "Packer-to-Tubing Forces for Intermediate Packers," SPE-7552, J Pet Technol, Mar. 1980, 32(3), 13 pages.

Hossam et al., "Modeling and Validation of Fluid Flow-Geomechanics of Mauddud Reservoir in Sabriya Field*," Search and Discovery Article #41052, Oct. 2012, 14 pages.

Kang et al., "Force Calculation with Oil Well Packer: A Revisit," IPTC-20324-MS, International Petroleum Technology Conference, presented at the International Petroleum Technology Conference held inDhahran, Saudi Arabia, Jan. 13-15, 2020, 16 pages.

Mason and Chen, "The Perfect Wellbore," SPE 95279 presented at the SPE Annual Technical Conference and Exhibition held in Dallas, Texas, USA, Oct. 9-12, 2005, 15 pages.

Rahman et al., "Geomechanical sweet spot identification in unconventional resources development," SPE-182247-MS, Society of Petroleum Engineers, presented at the SPE Asia Pacific Oil & Gas Conference and Exhibition held in Perth, Australia, Oct. 25-27, 2016, 19 pages.

Suarez-Rivera et al., "Seismic-Based Heterogeneous Earth Model Improves Mapping Reservoir Quality and Completion Quality in Tight Shales," Society of Petroleum Engineers, Apr. 10, 2013, 11 pages.

Xu et al., "Mechanism Study of Casing Deformation in Multistage Hydraulic Fracturing Shale Reservoir," URTeC: 2886020, presented at the Unconventional Resources Technology Conference, Houston, Texas, Jul. 23-25, 2018, 8 pages.

Xu et al., "Mechanism Study of Casing Deformation in Multistage Hydraulic Fracturing Shale Reservoir," URTEC-2896020-MS, Unconventional Resources Technology Conference, Jul. 23-25, 2018, 8 pages.

Zhang and Samuel, "Analytical Model to Estimate the Directional Tendency of Point and Push-the-Bit BHAs," SPE-174798-MS, Society of Petroleum Engineers, presented at the SPE Annual Technical Conference and Exhibition held in Houston, Texas, USA, Sep. 28-30, 2015, 12 pages.

Zhang and Samuel, "Stress Redistribution Analysis in Multiple Eccentric Packers During Completion Operations," SPE 166145, Society of Petroleum Engineers, Oct. 2013, 9 pages.

Zhao et al., "The Casing Deformation During Shale Gas Hydraulic Fracturing: Why it is so Serious in Weiyuan-Changning, China?" SPE-191273-MS, Society of Petroleum Engineers, presented at the SPE Trinidad and Tobago Section Energy Resources Conference held in Port of Spain, Trinidad and Tobago, Jun. 25-26, 2018, 14 pages.

* cited by examiner

MAINTAINING INTEGRITY OF LOWER COMPLETION FOR MULTI-STAGE FRACTURING

TECHNICAL FIELD

This disclosure relates to completion design for production of hydrocarbons from underground reservoirs.

BACKGROUND

Horizontal drilling and completion advances in tight oil/gas and shales have allowed access to significant new resources both in existing fields and new plays. Open-hole multi-stage fracturing (MSF) technologies using ball operated sleeves and open-hole packers have generally been effective in delivering high productivity wells, worldwide. In some situations, the wells completed with open-hole MSF experience deformation in certain sections of the liner during fracturing operations. Pipe deformation affects the wellbore integrity resulting in a loss of liner drift along the wellbore and, in some cases, loss of zonal isolation.

SUMMARY

This disclosure describes methods, systems, and apparatus for designing a well completion and completing a well drilled into a subterranean formation.

Certain aspects of the subject matter herein can be implemented as a method. The method includes designing a lower completion string for a multi-stage hydraulic fracturing job for a wellbore drilled into a subterranean zone. The lower completion string includes a plurality of stages and a plurality of packers configured to isolate each of the stages. Each stage of the plurality of stages includes a respective tubular stage assembly, and each stage is configured to be placed within a respective one of a plurality of frac intervals of the wellbore defined by the plurality of packers. Designing the lower completion string includes, for each stage of the plurality of stages, receiving a measured hole diameter of the respective one of the plurality of frac intervals and performing an axial safety factor analysis of the stage. The axial safety factor analysis includes a comparison of a yield strength in tension or compression of the respective tubular stage assembly of the stage with calculated effective axial tensile or compressive forces to which the respective tubular stage assembly of the stage would be subject when positioned in the frac interval in the wellbore during the multi-stage hydraulic fracturing job. The axial safety factor analysis uses a predicted anchored status of the lower completion string, which includes an extent to which the respective tubular stage assembly would be predicted to elongate or contract when the lower completion string is positioned in the wellbore and the plurality of packers are set. The axial safety factor analysis also uses a distance between a first packer of the plurality of packers isolating the stage and a second packer of the plurality of packers isolating the stage, and a measured hole diameter of the respective frac interval. The method also includes determining that the axial safety factor analysis for each stage of the plurality of stages satisfies a threshold and, in response to the determining that the threshold is satisfied for each stage of the plurality of stages, inserting the lower completion string into the wellbore and performing the multi-stage hydraulic fracturing job.

An aspect combinable with any of the other aspects can include the following features. The distance between the first packer of the plurality of packers isolating the stage and the second packer of the plurality of packers isolating the stage changes due to axial stress.

An aspect combinable with any of the other aspects can include the following features. Performing the axial safety factor analysis of the stage further uses a range of possible borehole temperatures of the respective frac interval, the range being at least about 15% greater or less than a calculated expected borehole temperature of the respective frac interval.

An aspect combinable with any of the other aspects can include the following features. Performing the axial safety factor analysis of the stage further uses a range of possible reservoir pressures at the respective frac interval, the range being at least about 10% greater or less than a predicted reservoir pressure at the respective frac interval.

An aspect combinable with any of the other aspects can include the following features. Performing the axial safety factor analysis of the stage further uses a predicted time delay between injection of frac fluid from a first stage of the plurality of stages and injection of frac fluid from a second stage of the plurality of stages, wherein the stage is the second stage.

An aspect combinable with any of the other aspects can include the following features. Performing the axial safety factor analysis of the stage further uses a measured dog-leg severity of the respective one of the plurality of frac intervals.

Certain aspects of the subject matter herein can be implemented as a computer-implemented method. For a design for a lower completion string for a multi-stage hydraulic fracturing job in a wellbore drilled into a subterranean zone, the lower completion string including a plurality of stages and a plurality of packers configured to isolate each of the stages, each stage of the plurality of stages including a respective tubular stage assembly, each stage configured to be placed within a respective one of a plurality of frac intervals of the wellbore defined by the plurality of packers, the computer-implemented method includes, for each stage of the plurality of stages receiving a measured hole diameter of the respective one of the plurality of frac intervals. The method also includes performing, for each stage of the plurality of stages, an axial safety factor analysis of the stage, including a comparison of a yield strength in tension or compression of the respective tubular stage assembly of the stage with calculated effective axial tensile or compressive forces to which the respective tubular stage assembly of the stage would be subject when positioned in the frac interval in the wellbore during the multi-stage hydraulic fracturing job. The axial safety factor analysis uses a predicted anchored status of the lower completion string, which includes the extent to which the respective tubular stage assembly would be predicted to elongate or contract when the lower completion string is positioned in the wellbore and the plurality of packers are set. The axial safety factor analysis also uses a distance between a first packer of the plurality of packers isolating the stage and a second packer of the plurality of packers isolating the stage, and the measured hole diameter of the respective of the plurality of frac intervals. The method also includes determining that the axial safety factor analysis for each stage of the plurality of stages satisfies a threshold and, in response to the determining that the threshold is satisfied, outputting an analysis that the axial safety factor analysis for the plurality of stages satisfies the threshold.

An aspect combinable with any of the other aspects can include the following features. The distance between the first packer of the plurality of packers isolating the stage and the second packer of the plurality of packers isolating the stage changes due to axial stress.

An aspect combinable with any of the other aspects can include the following features. Performing the axial safety factor analysis of the stage uses a range of possible borehole temperatures of the respective frac interval, range being at least about 15% greater or less than a calculated expected borehole temperature of the respective frac interval.

An aspect combinable with any of the other aspects can include the following features. Performing the axial safety factor analysis of the stage further uses a range of possible reservoir pressures at the respective frac interval, the range being at least about 10% greater or less than a predicted reservoir pressure at the respective frac interval.

An aspect combinable with any of the other aspects can include the following features. Performing the axial safety factor analysis of the stage further uses a predicted time delay between injection of frac fluid from a first stage of the plurality of stages and injection of frac fluid from a second stage of the plurality of stages, wherein the stage is the second stage.

An aspect combinable with any of the other aspects can include the following features. The method also includes receiving a measured dog-leg severity of the respective one of the plurality of stages, and wherein performing the axial safety factor analysis of the stage further uses the measured dog-leg severity.

An aspect combinable with any of the other aspects can include the following features. The method also includes, in response to the determining that the threshold is not satisfied, outputting alarm that the axial safety factor analysis for the plurality of stages does not satisfy the threshold.

Certain aspects of the subject matter herein can be implemented as a non-transitory computer readable medium storing computer instructions, executable by one or more processors to perform operations. For a design for a lower completion string for a multi-stage hydraulic fracturing job in a wellbore, the lower completion string including a plurality of stages and a plurality of packers configured to isolate each of the stages, each stage of the plurality of stages including a respective tubular stage assembly, each stage configured to be placed within a respective one of a plurality of frac intervals of the wellbore defined by the plurality of packers, the operations include, for each stage of the plurality of stages, receiving a measured hole diameter of the respective one of the plurality of frac intervals. The operations further include performing, for each stage of the plurality of stages, an axial safety factor analysis of the stage, the axial safety factor analysis including a comparison of a yield strength in tension or compression of the respective tubular stage assembly of the stage with calculated effective axial tensile or compressive forces to which the respective tubular stage assembly of the stage would be subject when positioned in the frac interval in the wellbore during the multi-stage hydraulic fracturing job. The axial safety factor analysis uses a predicted anchored status of the lower completion string, which includes the extent to which the respective tubular stage assembly would be predicted to elongate or contract when the lower completion string is positioned in the wellbore and the plurality of packers are set. The axial safety factor analysis also uses a distance between a first packer of the plurality of packers isolating the stage and a second packer of the plurality of packers isolating the stage and the measured hole diameter of the respective of the plurality of frac intervals. The operations also include determining that the axial safety factor analysis for each stage of the plurality of stages satisfies a threshold and, in response to the determining that the threshold is satisfied, outputting an analysis that the axial safety factor analysis for the plurality of stages satisfies the threshold.

An aspect combinable with any of the other aspects can include the following features. The distance between the first packer of the plurality of packers isolating the stage and the second packer of the plurality of packers isolating the stage changes due to axial stress.

An aspect combinable with any of the other aspects can include the following features. Performing the axial safety factor analysis of the stage further uses a range of possible borehole temperatures of the respective frac interval, the range being at least about 15% greater or less than a calculated expected borehole temperature of the respective frac interval.

An aspect combinable with any of the other aspects can include the following features. Performing the axial safety factor analysis of the stage further uses a range of possible reservoir pressures at the respective frac interval, the range being at least about 10% greater or less than a predicted reservoir pressure at the respective frac interval.

An aspect combinable with any of the other aspects can include the following features. Performing the axial safety factor analysis of the stage further uses a predicted time delay between injection of frac fluid from a first stage of the plurality of stages and injection of frac fluid from a second stage of the plurality of stages, wherein the stage is the second stage.

An aspect combinable with any of the other aspects can include the following features. The operations further include receiving a measured dog-leg severity of the respective one of the plurality of stages, and wherein performing the axial safety factor analysis of the stage further uses the measured dog-leg severity.

An aspect combinable with any of the other aspects can include the following features. The operations further include, in response to the determining that the threshold is not satisfied, outputting alarm that the axial safety factor analysis for the plurality of stages does not satisfy the threshold.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes systems and methods to avoid tubular deformation of a lower completion string during multi-stage hydraulic fracturing operations. In some embodiments, the completion is an open-hole multi-stage fracturing (OH-MSF) completion. Pipe deformation in the lower completion can range from being a distortion in the shape of the pipe; i.e. a reduction in internal diameter of the pipe to splitting of the pipe. These solutions provide a mechanism to manage the downhole forces to relieve the tubular from deformation during the application of loads. By being able to avoid pipe deformation on a well, fracturing costs will be reduced, well integrity and safety of operations will be improved, and wellbore accessibility during the life of the well will be provided.

A well completion can be divided into two parts: the "lower completion" and the "upper completion." The lower completion is the part that communicates with the producing formation; for example, in an OH-MSF completion the production liner is run with fracturing sleeves and open-hole packers in the open-hole with no cement around the liner. The open-hole packers help compartmentalize the wellbore into pay zones of interest and the fracturing sleeves serve as points to access the formations in those selective compartments for fracture initiation.

Figure 1:
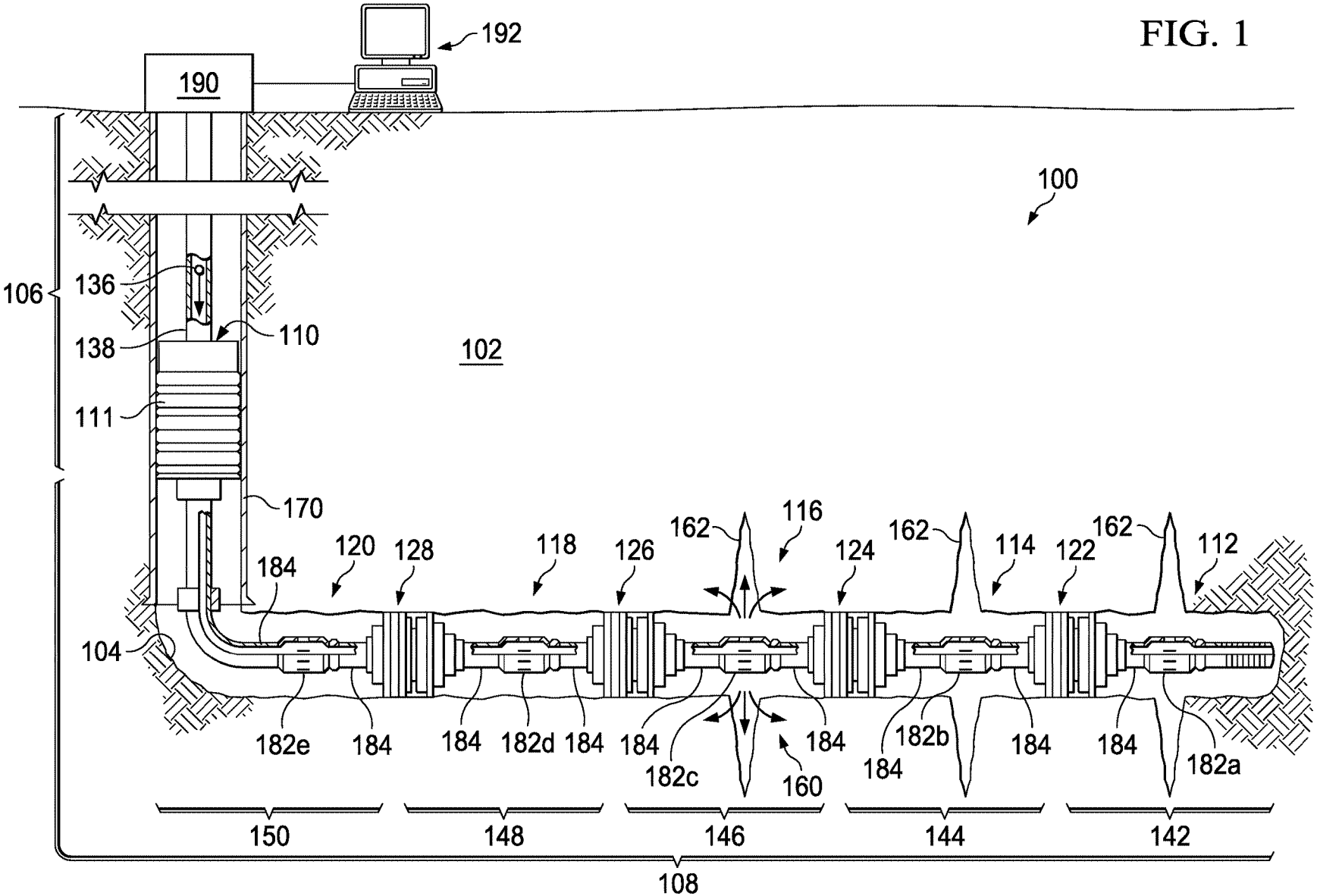
FIG. 1 is a schematic diagram of a system for performing a multi-stage hydraulic fracturing job of a subterranean formation, in accordance with an embodiment of the present disclosure.

FIG. 1 is a schematic diagram of a system 100 for performing a multi-stage hydraulic fracturing job ("frac job") of a subterranean formation 102, in accordance with an embodiment of the present disclosure. Referring to FIG. 1, a wellbore 104 has been drilled into a subterranean formation 102 from wellhead 190. Casing 170 has been cemented in the earlier upper hole section, which also includes upper completion string 106. Lower completion string 108 has been lowered into wellbore 104 and is suspended from liner hanger packer 111. Lower completion string 108 includes a plurality of stages. In the illustrated embodiment, lower completion string 108 includes five stages: first stage 112, second stage 114, third stage 116, fourth stage 118, and fifth stage 120. In some embodiments, a greater or lesser number of stages is included in the lower completion string. This liner section is tied back to the surface from liner hanger packer 111 and wellhead 190. A polished bore receptacle can be run above liner hanger packer 111 which provides a mating dock to latch the tie-back seal assembly 110 that connects lower completion string 108 to the wellhead. Upper completion tubing 138 connects tie-back seal assembly 110 to the surface.

Each stage is isolated from the other stages by one or more a packers. In the illustrated embodiment, first stage 112 at the toe end of wellbore 104 is isolated by first packer 122. Second stage 114 is isolated by first packer 122 and second packer 124, third stage 116 is isolated by second packer 124 and third packer 126, and fourth stage 118 is isolated by third packer 126 and fourth packer 128. Fifth stage 120 is isolated by fourth packer 128 and liner hanger and packer assembly 110. In some embodiments, the last stage isolated by the liner hanger and packer assembly may not be included. In some embodiments, packers 122, 124, 126, and 128 are open-hole packers. Open-hole packers can be activated by hydraulic pressure, be of inflatable type or of expandable metal or passive expansion of the packer in the presence of wellbore fluid, such as swell packers.

The plurality of packers isolating the stages define fracture intervals, which are the respective zones or segments of wellbore 104 into which fracturing fluid ("frac fluid") from each respective stage is injected into subterranean formation 102. In the illustrated embodiment, first stage 112 is configured to be placed within first frac interval 142, second stage 114 is configured to be placed within second frac interval 144, third stage 116 is configured to be placed within third frac interval 146, fourth stage 118 is configured to be placed within fourth frac interval 148, and fifth stage 120 is configured to be placed within fifth frac interval 150.

Each of stages 112, 114, 116, 118, and 120 includes a respective tubular stage assembly comprising sliding frac sleeves 182*a*, 182*b*, 182*c*, 182*d*, and 182*e*, respectively. The tubular stage assembly of a stage can also include one or more segments of liner 184 connecting the sliding frac sleeves of the stage with the respective packers (122, 124, 126, and 128) isolating the stage. The tubular stage assemblies of each stage further include various connections (for example, threaded connections) connecting the segments of liner 184 with the sliding frac sleeves and/or the packers isolating the respective stage. The tubular stage assembly of fifth stage 120 includes a segment of liner 184 connecting the sliding frac sleeve 182*e* of fifth stage 120 to liner hanger and packer assembly 110.

After inserting lower completion 108 in the wellbore, the multi-stage frac job can be performed. In the illustrated embodiment, a ball-drop type sleeve is shown; in other embodiments, other methods of sleeve actuation may be utilized instead of or in addition to a ball-drop type sleeve (for example, darts, RFID chips, and/or mechanical shifting tools). The frac sleeve system allows access to the multiple fracture intervals within the open-hole wellbore, and its ball activation feature enables sleeves to be actuated without intervention from surface. In this process, a specific ball sizes are sequentially dropped from surface and pumped down to the respective sliding sleeves 182 of each stage. In some embodiments, sliding sleeve 182*a* of first stage 112 can be a pressure activated sleeve that doesn't require a ball for activation. By applying pressure, sliding sleeve 182*a* of first stage 112 is moved and a frac port is exposed that provides a connection between the inside of the liner and first frac interval 142. After sliding sleeve 182*a* of first stage 112 has been opened, frac fluid 160 is injected through the frac ports of sliding frac sleeve 182*a* of first stage 112 to create fractures 162 in subterranean formation 102 in first frac interval 142. After fractures 162 have been created in first frac interval 142, a ball 136 is dropped into the wellbore and lodges in a seat of sliding frac sleeve 182*b* of second stage 114. By applying pressure sleeve 182*b* of second stage 114 is moved and a frac port is exposed that provides a connection between the inside of the liner and second frac interval 144. This pathway allows for second frac interval 144 to be hydraulically fractured by injection of frac fluid 160 to create fractures 162. This same ball also provides internal isolation between the first stage and the second stage.

At the conclusion of second stage fracturing, a second ball of a larger diameter than the first ball is dropped and lands in the sliding sleeve 182*c* of third stage 116. By pressuring the wellbore, the second ball moves the frac sleeve and allows for third frac interval 146 to be fractured. At the conclusion of third stage fracturing, a third ball of a larger diameter than the second ball is dropped which lands in the sliding sleeve 182*d* of fourth stage 118. By pressuring the wellbore, the third ball moves the frac sleeve and allows for fourth frac interval 148 to be fractured. At the conclusion of fourth stage fracturing, a fourth ball of a larger diameter than the third ball is dropped which lands in the sliding sleeve 182*e* of fifth stage 120. By pressuring the wellbore, the fourth ball moves the frac sleeve and allows for fifth frac interval 150 to be fractured. After all fracturing has been completed for all five stages, hydrocarbons can be produced from the well.

Figure 3A:
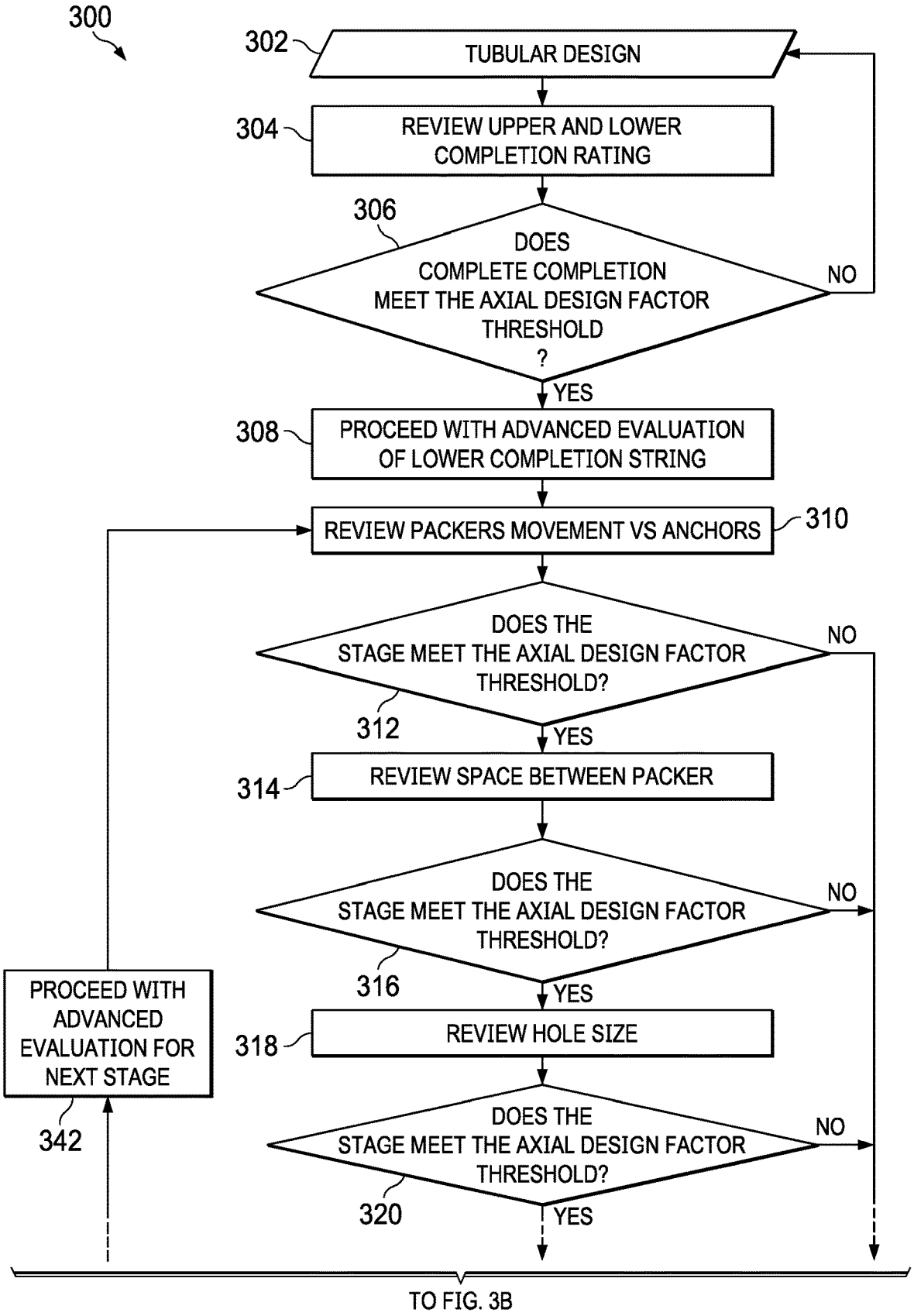
FIGS. 3A-3B are a process flow diagram of a method for designing a lower completion string of a multi-stage hydraulic fracturing system, in accordance with an embodiment of the present disclosure.
Figure 3B:
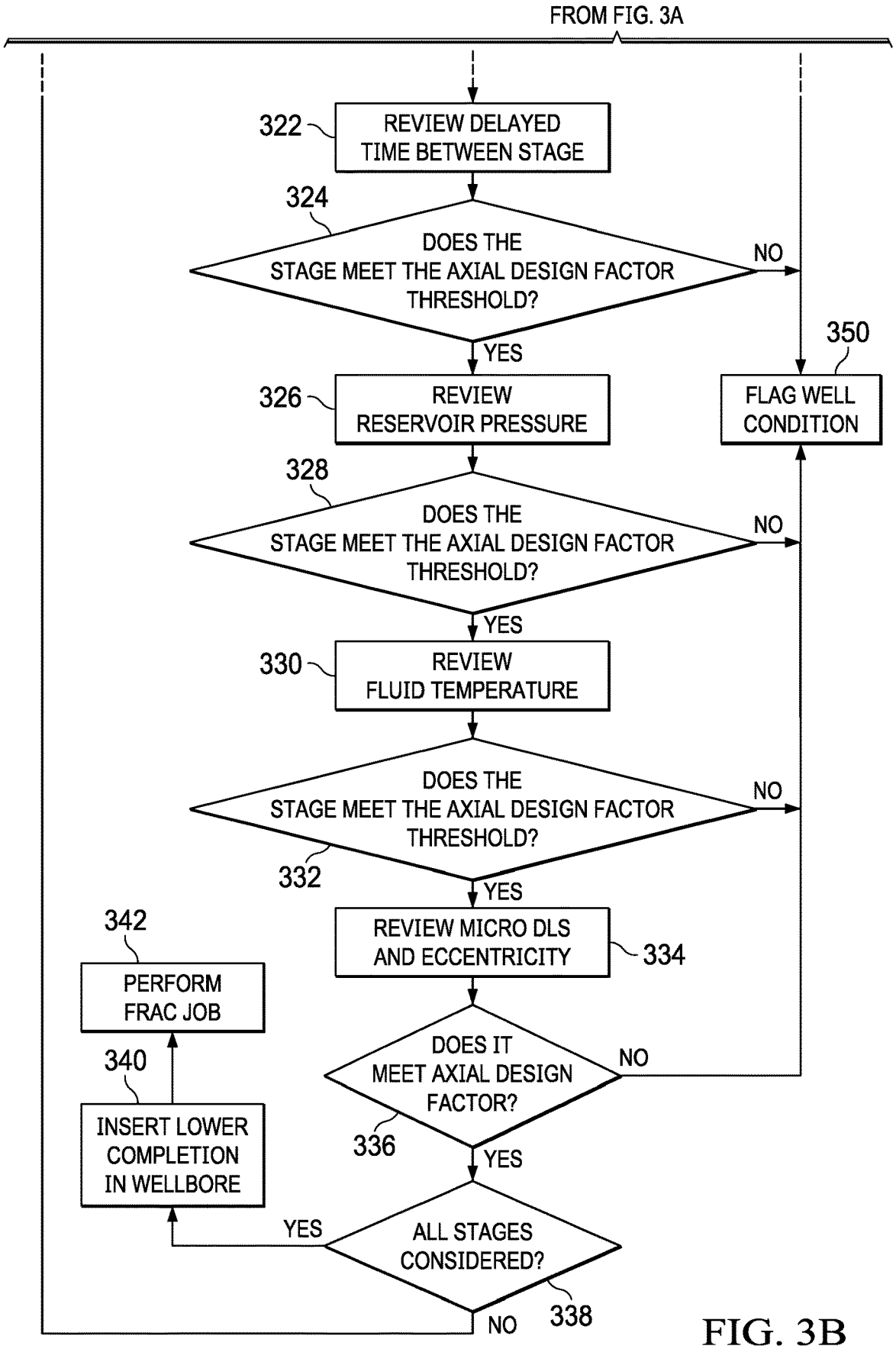

System 100 further includes computer system 192 which can perform various functions relating to the design and operation of system 100 in accordance with embodiments of the present disclosure, including but not limited to the design of the lower completion string 108 as described further in reference to FIGS. 3A-3B. Computer system 192 can be configured to receive certain information regarding wellbore 104, including but not limited to a measured diameter of wellbore 104 at each of frac intervals and the dog-leg severity of the frac intervals. Computer system 192 can in some embodiments be located at or near the wellsite for wellbore 104 or can be at a location remote from the wellsite (such as an office). Computer system 192 can include one or more processors, and a computer-readable medium (for example, a non-transitory computer-readable medium) storing computer instructions executable by the one or more processors to perform operations.

In designing a lower completion string, such as lower completion string 108 of system 100, avoidance of tubular deformation is an important consideration. Tubular deformation can present a particular problem in an open-hole, multiple packer arrangement in a horizontal well such as system 100. Repetitive pressure and temperature cycles can create cyclic stress load normally not experienced in conventional, single stage fracturing jobs.

There are four possible failure modes for a tube:

1. Parting of the tubing under axial load.
2. Bursting of the tubing due to internal pressure.
3. Collapse of the tubing under external pressure.
4. When the combined stress, or triaxial stress, exceeds the yield stress of the tubing.

In considering tubular deformation, the influence of thermal loading and pressure prediction across open-hole packers, fundamental tribology associated with open-hole packers, and other variables that contribute to failures, can be considered. Such other variables can include packer setting depth, reference position of frac sleeves and open-hole anchors, bottom hole temperature during treatment, lower completion design, dog-leg severity, and enlarged hole size influence.

The forces applied on a production packer changes with changing bottomhole conditions (for example, changes in pressure and temperature) resulting from normal operations like production, injection, shut-in, pressure testing of the completion, hydraulic fracturing, etc. The changes in pressure and temperature make the tubing connected to the packer to contract or expand (i.e. length change) and if the tubing is fixed (i.e. not allowed to move) and it reaches the movement limit, the additional load can deform or corkscrew the tubing or cause packer failure. This consideration becomes even more complicated when dealing with a multiple packer arrangement in a horizontal well as a number of additional variables come into play. For example, in an open-hole environment the hole size is not necessarily uniform and this by itself can have significant variations on the forces applied on open-hole packers. Packers are generally designed to set in symmetrical wellbores but with non-uniform wellbore diameters in horizontal wells the packer will adjust its form to the hole eccentricity which can reduce the stress limits of the packer.

The equations used for calculating forces, such as tubing axial load, piston effect, tubing-to-packer force, and packer-to-casing force, are established but can be complicated by the pressure discontinuity and axial load discontinuity that occurs during different phases of well operations. In multi-stage fracturing operations, the problem becomes extremely complex due to the high frequency of changing operations and the time delays between the various stages which puts the packer element at varying load conditions. In multi-stage fracturing operations, the fluids pumped are of different densities and viscosities resulting in changing hydraulics and wellbore temperatures leading to varying applied forces on the packers and tubulars. Resolving these complications for each stage can be advantageous.

Figure 2:
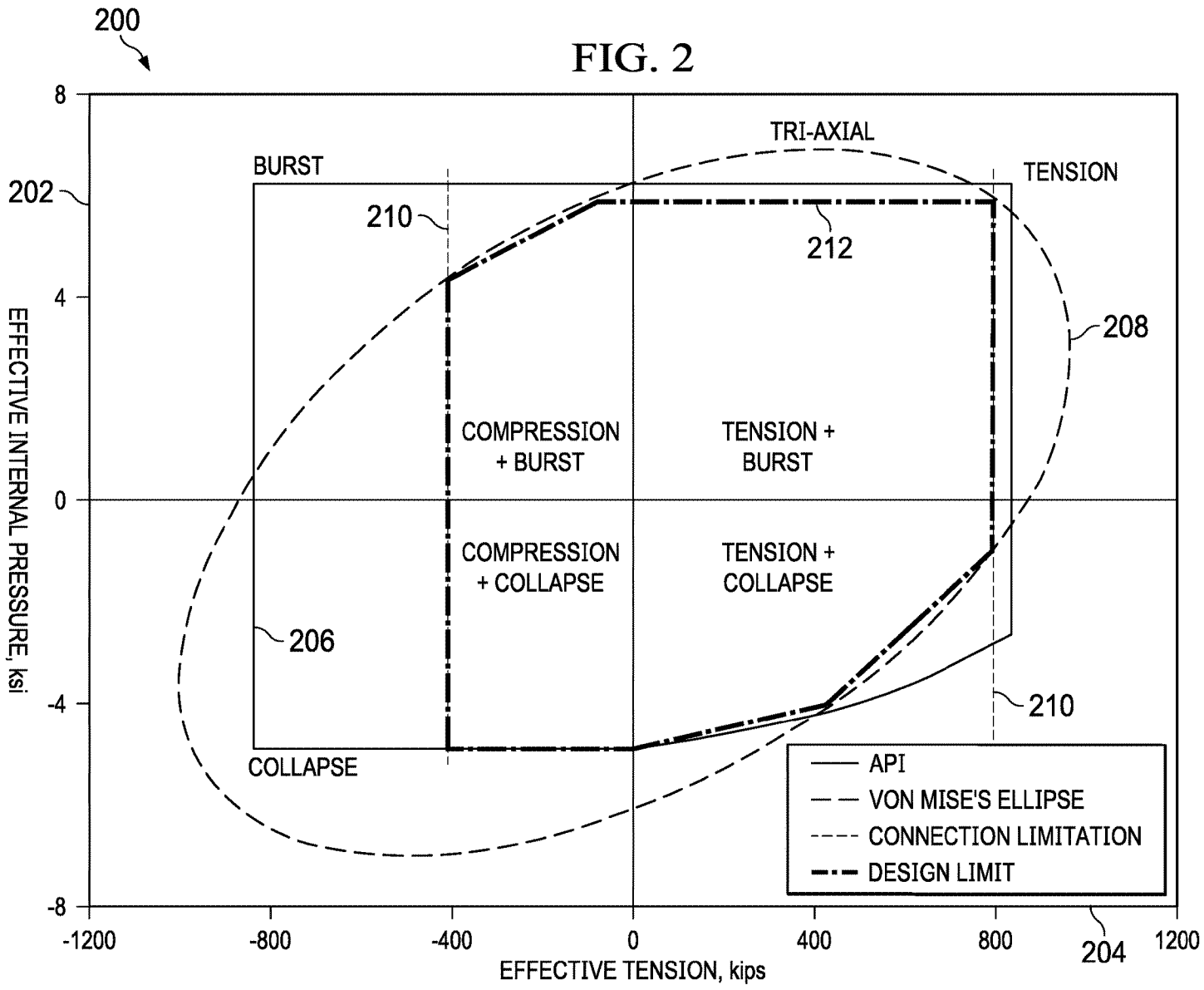
FIG. 2 is an illustration of an analysis of principal stresses on a tubular of a stage of a multi-stage lower completion string, in accordance with an embodiment of the present disclosure.

FIG. 2 is an illustration of an analysis 200 of principal stresses on a tubular of a stage of a multi-stage lower completion string, in accordance with an embodiment of the present disclosure. An acceptable axial design would not exceed the American Petroleum Institute (API) published stress limits and the von Mises yield criteria for the tubulars. Furthermore, the strength of the connections between the tubulars and other components (such as packers and sleeve components) of the stage should be considered. Referring to FIG. 2, vertical axis 202 corresponds to the differential pressure applied across a tubular and horizontal axis 204 corresponds to axial stress applied on the tubular. An acceptable stage design would need to fall within design limit 212, which as plotted does not exceed API standard stress limit 206, Von Mises ellipse 208, and connection yield limitations 210.

FIGS. 3A-3B are a process flow diagram of a method 300 for designing a lower completion string of a multi-stage hydraulic fracturing system, in accordance with an embodiment of the present disclosure. The method begins at step 302 with the creation of a proposed upper and lower completion design, including tubular sections, packers, and sleeves and their respective connections and proposed locations and configurations.

Proceeding to step 304, an axial safety factor analysis is conducted for the upper and lower completion string. The axial safety factor analysis compares the yield strength in tension or compression of the entire completion string with calculated effective axial tensile or compressive forces to which the entire completion string would be subject when positioned in the wellbore. The calculations consider the length of tubular sections of the entire completion string, the number and position of packers, and the kind, number, and position of the connections (such as threaded connections) between the components. In some embodiments, the axial safety factor analysis can be conducted using commercially available software. For example, the WELLCAT™ brand program available from Landmark Graphics Corporation includes a component that performs stress analysis for tubulars, known as the "TUBE" design module. The TUBE design module analyzes tubing loads and movements, buckling behavior, and design integrity under complex mechanical, fluid pressure, and thermal loading conditions. The WELLCAT program can predict failures such as tubing collapse, buckling, triaxial (von Mises) stress failure, axial stress failure, and yield strength limit failures.

At step 306, it is determined whether the axial safety factor analysis for the upper and lower completion string meets the acceptable axial design factor threshold. In some embodiments, the acceptable axial design factor threshold would be if the yield strength (in tension or compression of the completion string) divided by the calculated effective axial tensile or compressive force (to which the completion string would be subject when positioned in the wellbore) is greater than one. In some embodiments, the acceptable threshold would include an additional safety factor; for example if the result of the division is 1.1 or greater.

If at step 306 the upper and lower completion string does not meet the acceptable axial design factor threshold, then the method proceeds back to 302 wherein the tubular design is reviewed and revised as necessary.

If at step 306 the upper and lower completion string does meet the axial design factor threshold, then the method proceeds to step 308 wherein one stage of the lower completion string is selected for the advanced evaluation of steps 310 through 336. In advanced evaluation, in contrast to the evaluation conducted in steps 304 and 306, an axial factor design analysis is conducted for each individual stage of the multi-stage design, and details regarding the individual stages and the corresponding frac interval (such as dogleg severity, measured hole size, packer placement, freedom of movement, and others) are used in calculating the expected effective stresses with respect to that stage. As with step 304, in some embodiments, a commercially available software, such as WELLCAT, can be used for the advanced axial factor design analysis of the individual stages.

After a stage is selected for analysis, the method proceeds to step 310 wherein the axial safety factor analysis of that stage is conducted, specifically considering the extent to which the respective tubular stage assembly would be predicted to elongate or contract when the lower completion string is positioned in the wellbore and the plurality of packers are set. The nature and extent of lateral movement of the packers depends on several parameters, including, frictional resistance to movement from stress against open hole that is introduced from packer setting forces, number of packers in the designed lower completion, contact length of packer with open hole, and, presence and position of any latching or anchoring tools in the lower completion. The conditions that cause the pipe to move or not depend on whether the above combined resistance to movement of the lower completion is exceeded during stimulation by axial forces created from pipe cooling and ballooning, and any differential piston forces induced during stimulation. The extent to which the lower completion string can move can result in different pipe stresses when subjected to different pressures and temperatures. In some embodiments, for example, the axial safety factor analysis assumes a lack of such freedom of movement (such as by assuming an anchor is included in the completion and/or the existence of high frictional resistance to movement) and determines whether a lack of such freedom of movement can result in the stage exceeding its yield strength.

The method then proceeds to step 312, wherein it is determined whether the stage meets the acceptable axial design factor threshold for that stage, considering the extent to which the respective tubular stage assembly would be predicted to elongate or contract as inputted in step 310. If at step 312 the stage does not meet the axial design factor threshold, then the method proceeds to step 350 wherein a possible tubular failure is flagged and the stage and/or the rest of the lower completion may be redesigned as necessary. In some embodiments, at step 350, the flagging can be in the form of an alarm generated by the modeling software. In some embodiments, after step 350, the distance between the packers can be reviewed and adjusted as a potential solution in re-designing the stage completion to manage the adverse axial stresses, in which case the method proceeds to step 314 as described below.

If at step 312 the stage does meet the axial design factor threshold, then the method proceeds to step 314 wherein an axial safety factor analysis is conducted considering the distance between packers for the stage. A shorter distance between the packers (assuming high resistance to movement) can result in a more taut string and thus increased stresses for that stage. In some embodiments, the distance between the packers can change due to axial stresses.

The method then proceeds to step 316, wherein it is determined whether the stage meets the acceptable axial design factor threshold for that stage, considering the distance between the packers for the stage as inputted in step 314. If at step 316 the stage does not meet the axial design factor threshold, then the method proceeds to step 350 wherein a possible tubular failure is flagged and the stage and/or the rest of the lower completion may be redesigned as necessary.

If at step 316 the stage does meet the axial design factor threshold, then the method proceeds to step 318 wherein the actual hole size of the frac interval corresponding to the stage is considered in the axial safety factor analysis. In contrast to step 304 in which an assumed hole size for the entire wellbore may be assumed (based on the size of the drill bit), in step 318 a measured hole size for the frac interval using caliper data can be used. Variations in hole sizes will result in different cross-sectional areas and hence different stresses for the axial safety factor analysis.

The method then proceeds to step 320, wherein it is determined whether the stage meets the acceptable axial design factor threshold for that stage, considering the measured hole size for the frac interval of the stage as inputted in step 318. If at step 320 the stage does not meet the axial design factor threshold, then the method proceeds to step 350 wherein a possible tubular failure is flagged and the stage and/or the rest of the lower completion may be redesigned as necessary.

If at step 320 the stage does meet the axial design factor threshold, then the method proceeds to step 322 wherein the planned time delay since the fracturing of the previous stage is considered in the axial safety factor analysis. As described above, in multi-stage fracturing, several stages are frac'd in sequence. The time delay between the fracs can be a couple of hours in some cases to greater than twenty-four hours. A longer time period between fracs can result in a higher differential pressure across the packers during the fracturing operations for the respective stages, thus resulting in higher stresses on the tubular components of that stage.

The method then proceeds to step 324, wherein it is determined whether the stage meets the acceptable axial design factor threshold for that stage, considering the planned time delay between the stages as inputted in step 322. If at step 324 the stage does not meet the axial design factor threshold, then the method proceeds to step 350 wherein a possible tubular failure is flagged and the stage and/or the rest of the lower completion may be redesigned as necessary.

If at step 324 the stage does meet the axial design factor threshold, then the method proceeds to step 326 wherein possible variation in the actual reservoir pressure at the stage is considered in the axial safety factor analysis. Although reservoir pressure may be measured and/or calculated, some variation in actual reservoir pressure may be expected at the time of fracturing of the individual stage and this range of pressures can affect stresses on the tubular components. Therefore, the axial safety factor analysis is conducted for the stage assuming that the reservoir pressure when the stage is frac'ed may be from about 10% lower to about 10% higher than reservoir pressure predicted during the design phase. It should be noted that the advanced analysis is based on the assumption that the burst and collapse safety design factors are acceptable from the initial tubular design in step 302 and there are no change in pressures. In step 326 if the reservoir pressure is assumed to be below the initial assumption (more critical scenario), then the tubular design will be re-evaluated using the new applicable burst/collapse safety design factors. The completion designer will be in a better position at the time of the assessment to account for the pressure uncertainty if it exists.

The method then proceeds to step 328, wherein it is determined whether the stage meets the acceptable axial design factor threshold for that stage, considering the possible variation in reservoir pressure as inputted in step 324. If at step 328 the stage does not meet the axial design factor threshold, then the method proceeds to step 350 wherein a possible tubular failure is flagged and the stage and/or the rest of the lower completion may be redesigned as necessary.

If at step 328 the stage does meet the axial design factor threshold, then the method proceeds to step 330 wherein possible variation in the temperature in the circulating frac fluid is considered in the axial safety factor analysis. Some variation in from the calculated expected bottombole circulating frac fluid temperature may be expected at the time of fracturing of the individual stage and this range of temperatures can affect stresses on the tubular components. Therefore, the axial safety factor analysis is conducted for the stage assuming that the circulating temperature when the stage is frac'ed may be from about 15% lower to about 15% higher than the calculated bottomhole circulating temperature. The completion designer will be in a better position at the time of the assessment to account for the temperature uncertainty if it exists.

The method then proceeds to step 332, wherein it is determined whether the stage meets the acceptable axial design factor threshold for that stage, considering the range of circulating temperatures as inputted in step 328. If at step 332 the stage does not meet the axial design factor threshold, then the method proceeds to step 350 wherein a possible tubular failure is flagged and the stage and/or the rest of the lower completion may be redesigned as necessary.

If at step 332 the stage does meet the axial design factor threshold, then the method proceeds to step 334 wherein the dog-leg severity and tubular eccentricity of the stage is considered in the axial safety factor analysis. Dog-leg severity (DLS) is a measure of the amount of change in the inclination, and/or azimuth of a borehole, usually expressed in degrees per 100 feet of course length (or degrees per 30 meters of course length). Micro DLS is localized DLS that may not be captured in standard DLS measurements. The values of micro DLS can be higher than DLS. Bending stress is a function of modulus of elasticity and DLS; therefore if the micro DLS values are higher it can impact stress analysis. Micro-DLS values can be obtained from high-definition directional surveys performed while drilling the well. Pipe eccentricity is calculated on how well the tubulars of the stage are predicted to be centralized in the wellbore. It is expected that more stress will result in the pipe from bending moment in a crooked, eccentric pipe than a straight, smooth, centralized pipe.

The method then proceeds to step 336, wherein it is determined whether the stage meets the acceptable axial design factor threshold for that stage, considering the micro-DLS and eccentricity as inputted in step 332. If at step 336 the stage does not meet the axial design factor threshold, then the method proceeds to step 350 wherein a possible tubular failure is flagged and the stage and/or the rest of the lower completion may be redesigned as necessary.

If at step 336 the stage does meet the axial design factor threshold, then the method proceeds to step 338 wherein it is determined whether all stages of multi-stage lower completion have undergone advanced evaluation (i.e., have been analyzed using steps 310-336). If all stages have not undergone advanced analysis, the method proceeds to step 342 wherein a next stage is selected for advanced analysis. After step 342 wherein the next stage for advanced evaluation is selected, then the method returns to step 310 wherein the advanced evaluation begins for that next stage.

If at step 338 it is determined that all stages have undergone advanced evaluation and each stage has met the axial design factor threshold, the method proceeds to step 340 wherein the lower completion string is inserted into the wellbore. At step 342, the multi-stage frac job performed as described above with respect to FIG. 1. After the frac job is performed, hydrocarbons can be produced from the well using conventional procedures.

It will be understood that the steps 310 through 336 may in some embodiments be conducted in sequence or in parallel. It will be further understood that steps 310, 314, 318, 322, 326, 330, and 334 for a stage may in some embodiments be considered simultaneously in a single axial safety factor analysis; i.e., that determination steps 312, 316, 320, 324, 328, 332, and 336 can combined into a single determination step for that stage. It will be further understood that, in some embodiments, some (one or more) of steps 310, 314, 318, 322, 326, 330, and 334 (and their corresponding determination steps 312, 316, 320, 324, 328, 332, and 336) may be omitted from the enhanced analysis, and/or other stage-specific analyses may be conducted. In some embodiments, if at any of the determination steps 312,316, 320, 328, 332, and/or 336 the stage does not meet the axial design factor threshold and step 350 is flagged for possible tubular failure condition, then the lower completion may be redesigned by selectively using the same evaluation steps 310, 314, 318, 322, 326, 330 and 334 with different input parameters that can be physically controlled (e.g. spacing between packers, higher strength tubulars, maintaining pressure and temperature limits during the hydraulic fracturing treatment as shown in FIG. 4 and FIG. 5).

Figure 4:
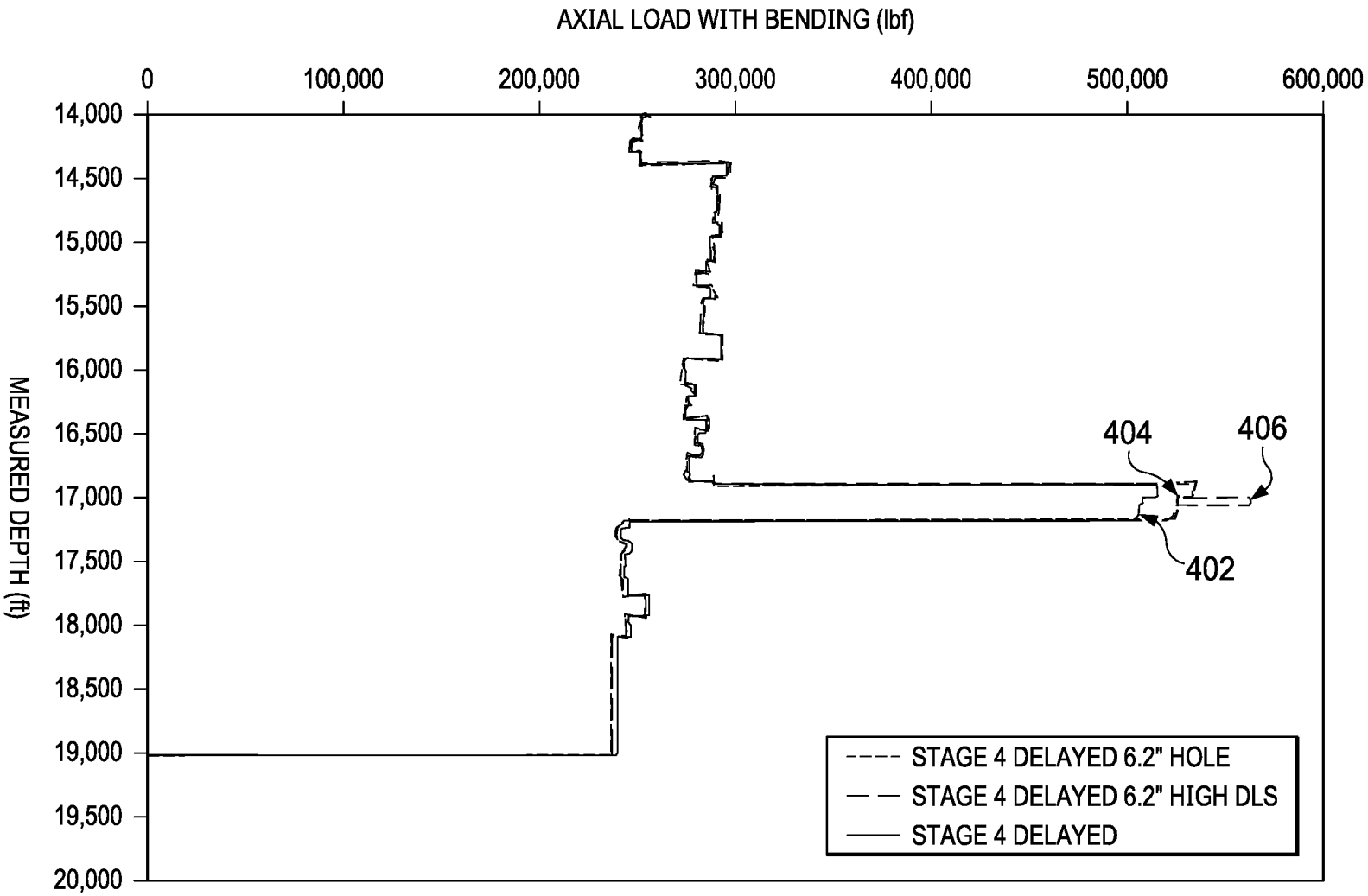
FIG. 4 is an illustration of calculated axial loads affecting a stage of a multi-stage hydraulic frac job in accordance with an embodiment of the present disclosure.

FIG. 4 is an illustration of calculated axial loads affecting a stage of a multi-stage hydraulic frac job in accordance with an embodiment of the present disclosure. Specifically, FIG. 4 illustrates the modeled axial load (with bending) of tubular components of a fourth stage of a multi-stage hydraulic frac job (such as fourth stage 118 of lower completion string 108 of FIG. 1).

The frac port for the fourth stage of FIG. 4 is at 16,988 feet total depth. The axial load modeled data for FIG. 4 assumes that there has been sufficient delay between stages for the wellbore pressure to return to reservoir pressure. Curve 402 represents axial load for the fourth stage, assuming a uniform wellbore diameter and straight hole based on the diameter of the drill bit. Curve 404 represents axial load for the fourth stage, using actual measured hole diameter for the wellbore at the fourth stage frac interval, based on an high definition wellbore caliper log which provides an accurate measurement of the open hole diameter. Curve 406 represents axial load for the fourth stage, using actual measured hole diameter for the wellbore at the fourth stage frac interval, based on the high-definition caliper log, and also measured actual dog-leg severity for that frac interval, based on directional survey data. Curve 404 shows the more axial load than curve 402, and curve 406 shows more axial load than curve 404, as additional stage-specific parameters (i.e., actual wellbore diameter and dog-leg severity) are added to the model. Additionally, the modeling shows that curves 402, 404, and 406 all exceeded the 500,000 lbf pipe strength limit in this particular case.

Figure 5:
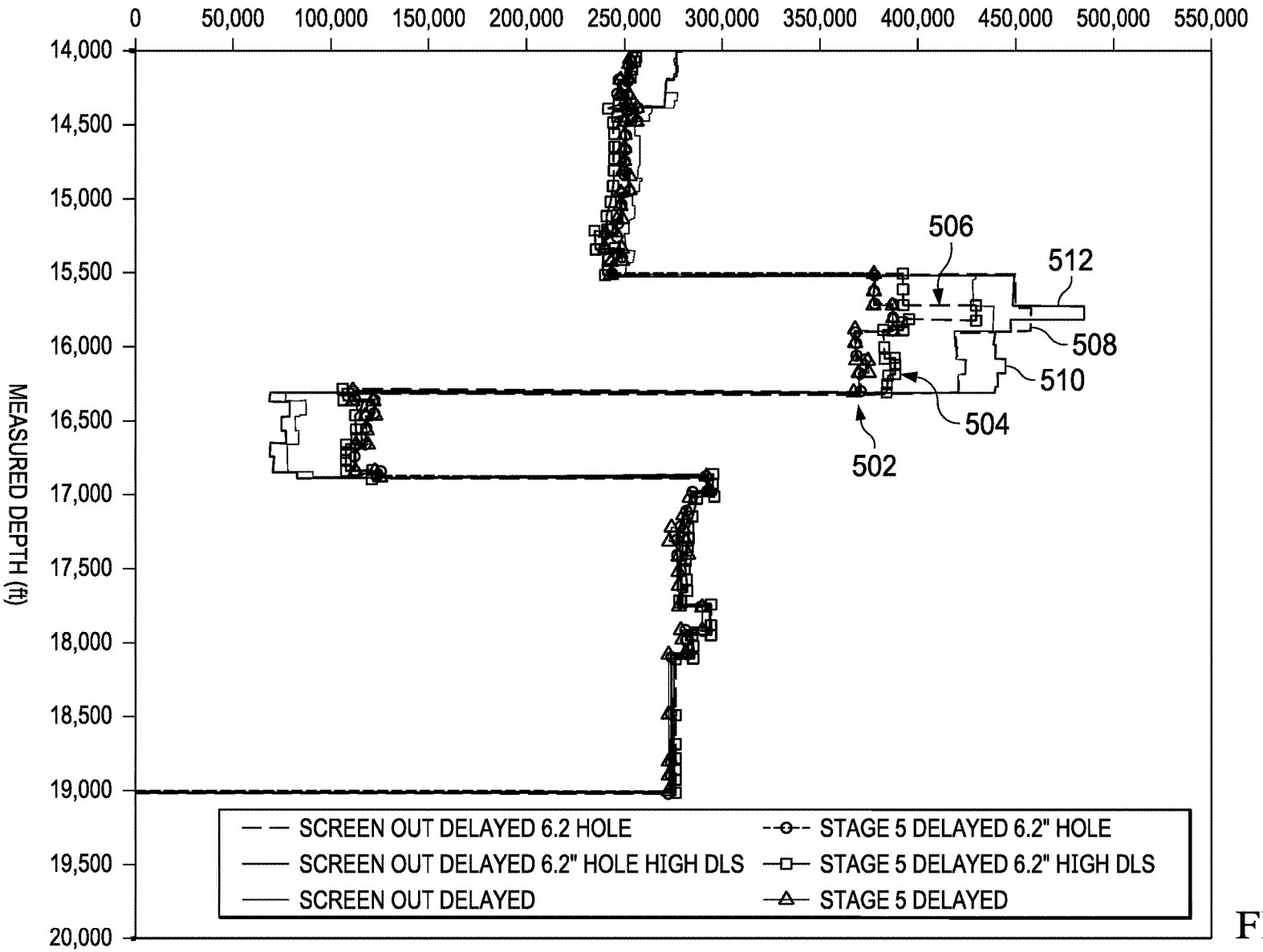
FIG. 5 is an illustration of calculated axial loads affecting a stage of a multi-stage hydraulic frac job in accordance with an embodiment of the present disclosure.

FIG. 5 is an illustration of calculated axial loads affecting a stage of a multi-stage hydraulic frac job in accordance with an embodiment of the present disclosure. Specifically, FIG. 5 illustrates the modeled axial load (with bending) of tubular components of a fifth stage of a multi-stage hydraulic frac job (such as fifth stage 120 of lower completion string 108 of FIG. 1).

The frac port for the fifth stage of FIG. 4 is at 15,899 feet total depth. The axial load modeled data for FIG. 5 assumes that there has been sufficient delay between stages for the wellbore pressure to return to reservoir pressure. Curve 502 represents axial load for the fifth stage, assuming a uniform wellbore diameter and straight hole based on the diameter of the drill bit. Curve 504 represents axial load for the fifth stage, using actual measured hole diameter for the wellbore at the fifth stage frac interval, based on an high definition wellbore caliper log which provides an accurate measurement of the open hole diameter. Curve 506 represents axial load for the fifth stage, using actual measured hole diameter for the wellbore at the fifth stage frac interval based on the high-definition caliper log, and also measured actual dog-leg severity for that frac interval, based on directional survey data. Curve 504 shows the more axial load than curve 502, and curve 506 shows more axial load than curve 504, as additional stage-specific parameters (i.e., actual wellbore diameter and dog-leg severity) are added to the model. In all these cases, the stresses do not exceed the equipment strength threshold of 500,000 lbf. Three additional loads (curves 508, 510, and 512) are thereafter modeled in this same plot which account for a proppant "screen-out" scenario. Proppant screen-out occurs in a proppant fracturing treatment where the hydraulic fracture created downhole in the formation cannot accept the amount of proppant being pumped and it plugs up creating an abnormal, unplanned increase in treating pressure. This eventuality is modeled as screen-out scenario and the additional pressures witnessed can be 15%-25% higher than planned pressures. The curves show that in such a scenario the equipment is approaching the failure limit.

The information in FIGS. 4 and 5 illustrates some of the factors that come into play in the two stages (stage 4 and stage 5) that were modeled. The location of the frac port in relation to the openhole packer can be particularly important. In stage 4 (FIG. 4), keeping the frac port too close to the pipe anchor resulted in higher axial stresses at lower treating pressures. In stage 5 (FIG. 5), the longer distance between the packers and the frac port resulted in better axial stress management.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

designing a lower completion string for a multi-stage hydraulic fracturing job for a wellbore drilled into a subterranean zone, the lower completion string comprising a plurality of stages and a plurality of packers configured to isolate each of the stages, each stage of the plurality of stages comprising a respective tubular stage assembly, each stage configured to be placed within a respective one of a plurality of frac intervals of the wellbore defined by the plurality of packers, wherein designing the lower completion string comprises, for each stage of the plurality of stages:

receiving a measured hole diameter of the respective one of the plurality of frac intervals;

performing an axial safety factor analysis of the stage, the axial safety factor analysis comprising a comparison of a yield strength in tension or compression of the respective tubular stage assembly of the stage with calculated effective axial tensile or compressive forces to which the respective tubular stage assembly of the stage would be subject when positioned in the frac interval in the wellbore during the multi-stage hydraulic fracturing job, and wherein the axial safety factor analysis uses:

a predicted anchored status of the lower completion string, wherein the predicted anchored status comprises an extent to which the respective tubular stage assembly would be predicted to elongate or contract when the lower completion string is positioned in the wellbore and the plurality of packers are set;

a distance between a first packer of the plurality of packers isolating the stage and a second packer of the plurality of packers isolating the stage; and the measured hole diameter of the respective frac interval;

determining that the axial safety factor analysis for each stage of the plurality of stages satisfies a threshold; and in response to the determining that the threshold is satisfied for each stage of the plurality of stages, inserting the lower completion string into the wellbore and performing the multi-stage hydraulic fracturing job.

2. The method of claim 1, wherein the distance between the first packer of the plurality of packers isolating the stage and the second packer of the plurality of packers isolating the stage changes due to axial stress.

3. The method of claim 1, wherein performing the axial safety factor analysis of the stage further uses a range of possible borehole temperatures of the respective frac interval, said range at least about 15% greater or less than a calculated expected borehole temperature of the respective frac interval.

4. The method of claim 1, wherein performing the axial safety factor analysis of the stage further uses a range of possible reservoir pressures at the respective frac interval, said range at least about 10% greater or less than a predicted reservoir pressure at the respective frac interval.

5. The method of claim 1, wherein performing the axial safety factor analysis of the stage further uses a predicted time delay between injection of frac fluid from a first stage of the plurality of stages and injection of frac fluid from a second stage of the plurality of stages, wherein the stage is the second stage.

6. The method of claim 1, wherein performing the axial safety factor analysis of the stage further uses a measured dog-leg severity of the respective one of the plurality of frac intervals.

7. A computer-implemented method, the method comprising:

for a design for a lower completion string for a multi-stage hydraulic fracturing job in a wellbore drilled into a subterranean zone, the lower completion string comprising a plurality of stages and a plurality of packers configured to isolate each of the stages, each stage of the plurality of stages comprising a respective tubular stage assembly, each stage configured to be placed within a respective one of a plurality of frac intervals of the wellbore defined by the plurality of packers, for each stage of the plurality of stages:

receiving a measured hole diameter of the respective one of the plurality of frac intervals;

performing an axial safety factor analysis of the stage, the axial safety factor analysis comprising a comparison of a yield strength in tension or compression of the respective tubular stage assembly of the stage with calculated effective axial tensile or compressive forces to which the respective tubular stage assembly of the stage would be subject when positioned in the frac interval in the wellbore during the multi-stage hydraulic fracturing job, and wherein the axial safety factor analysis uses:

a predicted anchored status of the lower completion string, wherein the predicted anchored status comprises an extent to which the respective tubular stage assembly would be predicted to elongate or contract when the lower completion string is positioned in the wellbore and the plurality of packers are set;

a distance between a first packer of the plurality of packers isolating the stage and a second packer of the plurality of packers isolating the stage; and the measured hole diameter of the respective of the plurality of frac intervals;

determining that the axial safety factor analysis for each stage of the plurality of stages satisfies a threshold; and in response to the determining that the threshold is satisfied, outputting an analysis that the axial safety factor analysis for the plurality of stages satisfies the threshold.

8. The computer-implemented method of claim 7, wherein the distance between the first packer of the plurality of packers isolating the stage and the second packer of the plurality of packers isolating the stage changes due to axial stress.

9. The computer-implemented method of claim 7, wherein performing the axial safety factor analysis of the stage further uses a range of possible borehole temperatures of the respective frac interval, said range at least about 15% greater or less than a calculated expected borehole temperature of the respective frac interval.

10. The computer-implemented method of claim 7, wherein performing the axial safety factor analysis of the stage further uses a range of possible reservoir pressures at the respective frac interval, said range at least about 10% greater or less than a predicted reservoir pressure at the respective frac interval.

11. The computer-implemented method of claim 7, wherein performing the axial safety factor analysis of the stage further uses a predicted time delay between injection of frac fluid from a first stage of the plurality of stages and injection of frac fluid from a second stage of the plurality of stages, wherein the stage is the second stage.

12. The computer-implemented method of claim 7, further comprising receiving a measured dog-leg severity of the respective one of the plurality of stages, and wherein performing the axial safety factor analysis of the stage further uses the measured dog-leg severity.

13. The computer-implemented method of claim 7, further comprising, in response to the determining that the threshold is not satisfied, outputting alarm that the axial safety factor analysis for the plurality of stages does not satisfy the threshold.

14. A non-transitory computer readable medium storing computer instructions, executable by one or more processors to perform operations, the operations comprising:

for a design for a lower completion string for a multi-stage hydraulic fracturing job in a wellbore, the lower completion string comprising a plurality of stages and a plurality of packers configured to isolate each of the stages, each stage of the plurality of stages comprising a respective tubular stage assembly, each stage configured to be placed within a respective one of a plurality of frac intervals of the wellbore defined by the plurality of packers, for each stage of the plurality of stages:

receiving a measured hole diameter of the respective one of the plurality of frac intervals;

performing an axial safety factor analysis of the stage, the axial safety factor analysis comprising a comparison of a yield strength in tension or compression of the respective tubular stage assembly of the stage with calculated effective axial tensile or compressive forces to which the respective tubular stage assembly of the stage would be subject when positioned in the frac interval in the wellbore during the multi-stage hydraulic fracturing job, and wherein the axial safety factor analysis uses:

a predicted anchored status of the lower completion string, wherein the predicted anchored status comprises an extent to which the respective tubular stage assembly would be predicted to elongate or contract when the lower completion string is positioned in the wellbore and the plurality of packers are set;

a distance between a first packer of the plurality of packers isolating the stage and a second packer of the plurality of packers isolating the stage; and the measured hole diameter of the respective of the plurality of frac intervals;

determining that the axial safety factor analysis for each stage of the plurality of stages satisfies a threshold; and in response to the determining that the threshold is satisfied, outputting an analysis that the axial safety factor analysis for the plurality of stages satisfies the threshold.

15. The non-transitory computer readable medium storing computer instructions of claim 14, wherein the distance between the first packer of the plurality of packers isolating the stage and the second packer of the plurality of packers isolating the stage changes due to axial stress.

16. The non-transitory computer readable medium storing computer instructions of claim 14, wherein performing the axial safety factor analysis of the stage further uses a range of possible borehole temperatures of the respective frac interval, said range at least about 15% greater or less than a calculated expected borehole temperature of the respective frac interval.

17. The non-transitory computer readable medium storing computer instructions of claim 14, wherein performing the axial safety factor analysis of the stage further uses a range of possible reservoir pressures at the respective frac interval, said range at least about 10% greater or less than a predicted reservoir pressure at the respective frac interval.

18. The non-transitory computer readable medium storing computer instructions of claim 14, wherein performing the axial safety factor analysis of the stage further uses a predicted time delay between injection of frac fluid from a first stage of the plurality of stages and injection of frac fluid from a second stage of the plurality of stages, wherein the stage is the second stage.

19. The non-transitory computer readable medium storing computer instructions of claim 14, wherein the operations further comprise receiving a measured dog-leg severity of the respective one of the plurality of stages, and wherein performing the axial safety factor analysis of the stage further uses the measured dog-leg severity.

20. The non-transitory computer readable medium storing computer instructions of claim 14, wherein the operations further comprise, in response to the determining that the threshold is not satisfied, outputting alarm that the axial safety factor analysis for the plurality of stages does not satisfy the threshold.

* * * * *